US006345882B1

(12) United States Patent
Brechat

(10) Patent No.: US 6,345,882 B1
(45) Date of Patent: Feb. 12, 2002

(54) MAGNETOGRAPHIC PRINTING PROCESS

(75) Inventor: Pascal Brechat, Belfort (FR)

(73) Assignee: Nipson SA, Belfort (FR)

( * ) Notice: Subject to any disclaimer, the term of this patent is extended or adjusted under 35 U.S.C. 154(b) by 0 days.

(21) Appl. No.: 09/539,776

(22) Filed: Mar. 31, 2000

(30) Foreign Application Priority Data

Apr. 2, 1999 (FR) ..... 99-04129

(51) Int. Cl.[7] ..... B41J 2/16
(52) U.S. Cl. ..... 347/53
(58) Field of Search ..... 347/53, 74.2, 74.5, 347/225, 234, 248, 141, 55, 54, 20; 399/63, 74, 104, 229

(56) References Cited

U.S. PATENT DOCUMENTS 4,414,554 A 11/1983 Springer
5,699,088 A 12/1997 Isono et al.
5,712,675 A 1/1998 Dhong et al.

FOREIGN PATENT DOCUMENTS

FR 2664201 1/1992

*Primary Examiner*—Raquel Yvette Gordon
(74) *Attorney, Agent, or Firm*—Nixon & Vanderhye P.C.

(57) ABSTRACT

This invention relates to a magnetographic printing process consisting of creating magnetized recorded dots on a surface of a magnetic recording element (3) by at least one elementary magnetic head (2), spraying ink particles on each of the magnetized recorded dots in order to form images composed of image dots, and increasing the energy supplied to the first magnetized recorded dots compared with the energy supplied to other magnetized dots. This invention also relates to a magnetographic printer using the said process.

18 Claims, 4 Drawing Sheets

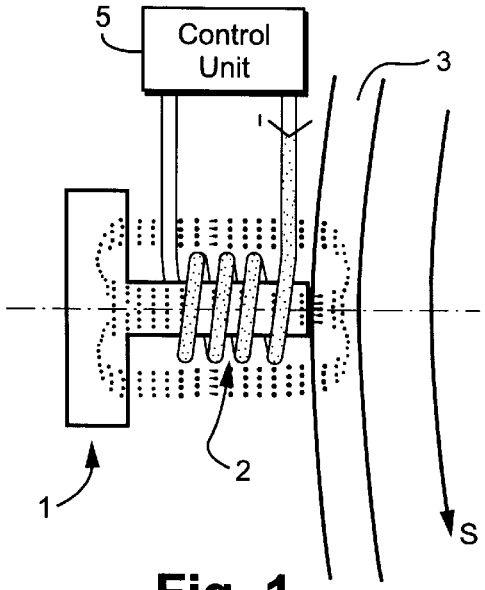
Fig. 1
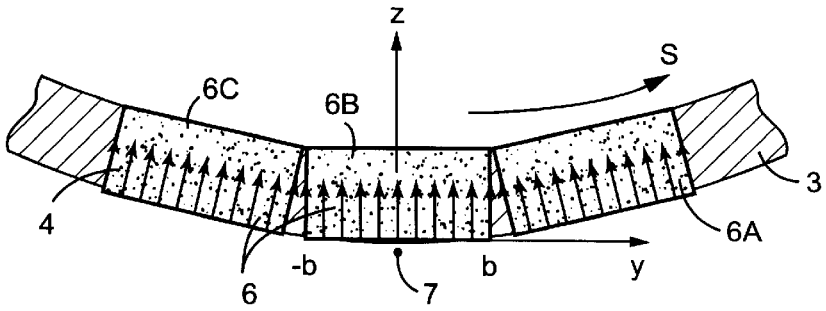
Fig. 2
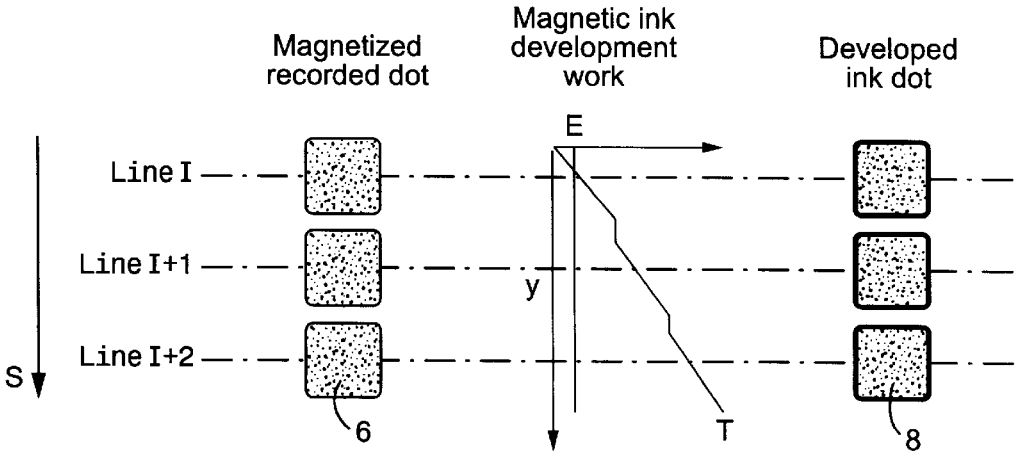
Fig. 3 *(Prior Art)*

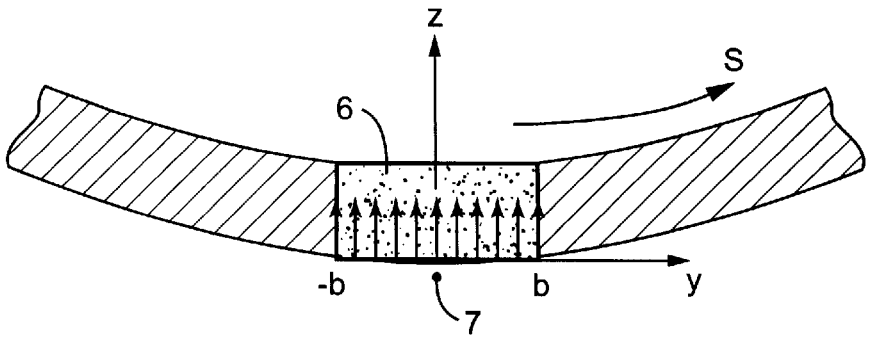
Fig. 8
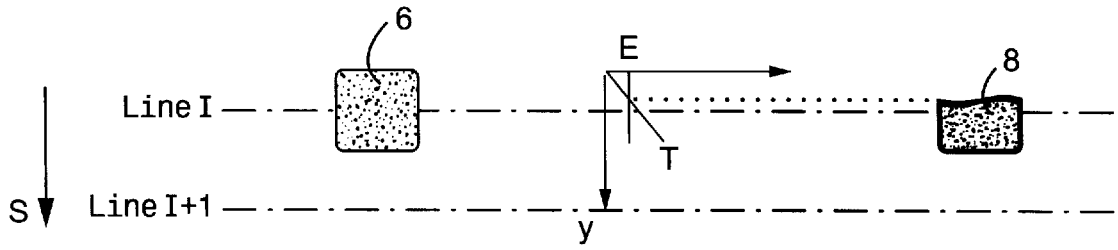
Fig. 9 *(Prior Art)*

MAGNETOGRAPHIC PRINTING PROCESS

This invention relates to the field of impact free magnetographic printers, and more particularly to printing processes used in this type of printer.

PRIOR ART

Magnetographic printers comprise a magnetic recording element that may be in various forms such as for example a drum, a tape or a disk. The magnetic recording element is composed of a substrate coated with a layer of magnetic material. Information is recorded on this element by means of at least one recording device called a module. The module comprises at least one elementary magnetic recording head close to which the recording element is moving. The elementary recording head is usually composed of an electromagnet.

Each of the elementary heads generates a magnetic field each time that it is excited by an electric current with a determined intensity, which has the effect of creating small magnetized areas on the surface of the recording element that advances in front of these elementary heads. These concentrated magnetized areas are usually called magnetized recorded dots. The portion of the surface of the element that passes in front of each head is usually called information recording tracks.

The magnetized recorded dots located on one recording track and preceded in the direction in which the recording element advances by at least one recorded dot that was not magnetized belong to a set of magnetized recorded dots called a leading edge.

The combination of recorded dots forms an image. Particles of magnetic ink are then attracted by recorded dots magnetized on the recording element. Paper to be printed is pressed in contact with the recording element. Particles of magnetic ink are transferred onto the paper and fixed on it; the image formed by recorded dots on the drum is transferred to paper using particles of magnetic ink.

It is found that as the speed of the recording element increases, the amount of ink applied for the magnetized recorded dots belonging to the leading edges reduces. The work done by the magnetic development force is not sufficient to deposit ink particles over the entire area of each magnetized recorded dots on the leading edge.

One purpose of this invention is to improve the homogeneity of the final image.

Another purpose of this invention is to improve inking of magnetized dots on the leading edge, while avoiding expending more energy to do this.

Another purpose of the invention is to improve the printing efficiency, namely the ratio between the optical density of an inked magnetic dot and the energy necessary to magnetize the dot concerned.

SUMMARY OF THE INVENTION

In this context, this invention proposes a magnetographic printing process consisting of creating magnetized recorded dots on a surface of a magnetic recording element by means of at least one elementary magnetic head, spraying ink particles on each of the magnetized recorded dots in order to form images composed of image dots, magnetized and inked recorded dots being called developed dots, characterized in that it consists of increasing the optical density of developed dots belonging to the leading edge.

This invention also relates to a magnetographic printer comprising at least one elementary magnetic head capable of creating magnetized recorded dots on a surface of the magnetic recording element, means of controlling the elementary magnetic head, means of spraying ink particles onto each of the magnetized recorded dots in order to form images composed of image dots, and characterized in that it comprises means of detection of the leading edge in association with the control means.

PRESENTATION OF THE FIGURES

Other characteristics and advantages of the invention will become clear after reading the following description, given as an illustrative and non-restrictive example of this invention, with reference to the attached drawings in which:

FIG. 1 is a partial cross-sectional view of an elementary magnetic head, of the associated control unit and a drum in a magnetographic printer;

FIG. 2 shows a partial cross-sectional view of the drum;

FIG. 3 shows magnetized recorded dots and the corresponding inked surface on the drum, and the energy balance according to a conventional printing process;

FIG. 8 represents a partial cross-sectional view of the drum;

FIG. 9 represents a single magnetized dot and the corresponding inked area on the drum and the energy balance in a conventional printing process;

DESCRIPTION OF AN EMBODIMENT OF THE INVENTION

Figure 4:
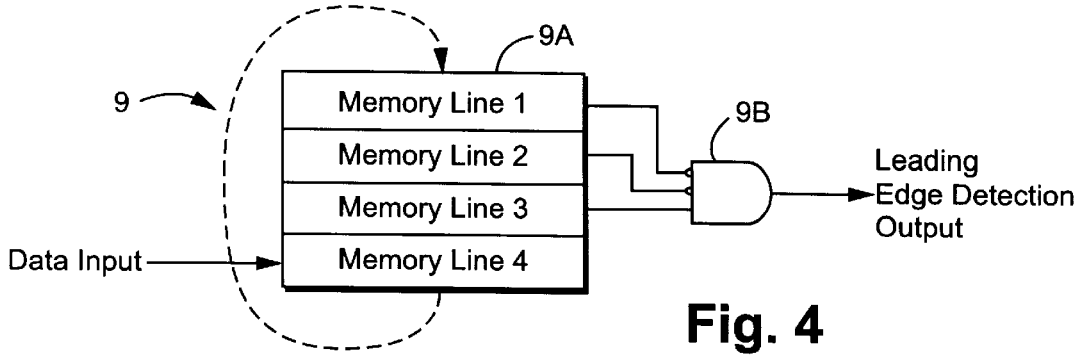
FIG. 4 shows a diagrammatic view of means of detection of the leading edge of the printer according to the invention.

This invention relates to a magnetographic printing process and a magnetographic printer using the process.

As shown diagrammatically in FIG. 1, the magnetographic printer according to the invention comprises at least one elementary magnetic head 2 placed close to the surface of a magnetic recording element 3. In the embodiment of the invention shown in FIG. 1, the elementary magnetic head is in the form of an electromagnet. Element 3 is composed of a rotating magnetic drum in the embodiment described and illustrated on the drawings. Element 3 could be in any other form, for example such as an endless magnetic belt. The drum 3 is driven in rotation about itself by an electric motor, in a direction shown on the drawings by the letter S. The portion of the area of the drum 3 that advances in front of each head is called the recording track 4 (see FIG. 2).

The elementary head 2 receives electrical signals representative of data sent by a control unit 5 represented by a black box in FIG. 1.

As shown in FIG. 2, the elementary magnetic heads record data received from unit 5 in the form of recorded dots 6 on drum 3.

In the embodiment shown in FIG. 1, electrical signals from unit 5 are composed of current pulses 1 transmitted to the elementary magnetic head 2. The magnetic field induces magnetized recorded dots 6 represented in FIGS. 2, 3, 6 to 9, due to the pulses created on the surface of the drum 3 that moves in front of the heads 2. A magnetized recorded dot is formed each time that there is a current pulse.

All recorded dots on the magnetic recording surface of the drum 3 correspond to the image to be printed on paper. The image may be in various forms such as drawings, character strings, photos, etc., or any other form that can be reproduced by printing. The image is recorded in a printer in the form of a matrix of dots arranged in rows and in columns. The dots on the matrix will be called image dots throughout the rest of this description to distinguish them from recorded dots 6. The image dots are white or black. Black dots are to be printed. The horizontal definition of the image depends on the distance between two elementary magnetic heads 2 laid out on the same row. The vertical definition is equal to the pitch between two rows. Pulses are sent periodically. The time interval between two pulses is equal to the time taken by the drum to travel the distance equal to the pitch between two rows in the image. This time interval is chosen such that the vertical definition is equal to a determined value regardless of the rotation speed of drum 3.

Figure 6:
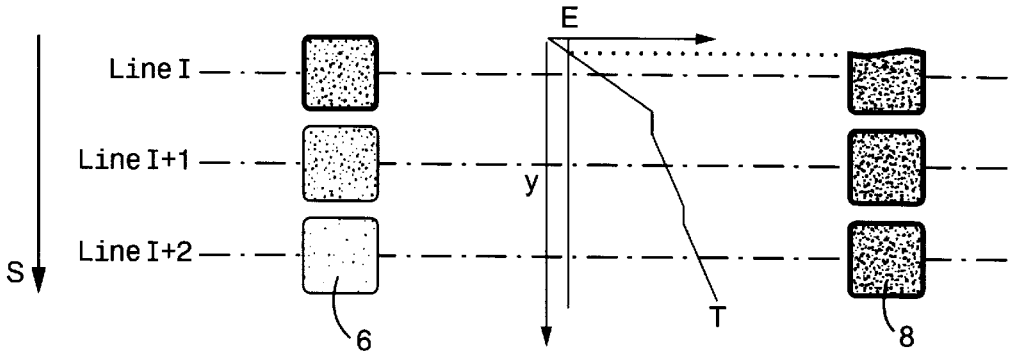
FIG. 6 represents magnetized recorded dots and the corresponding inked area on the drum and the energy balance, using a first and second embodiment of the process according to the invention.
Figure 7:
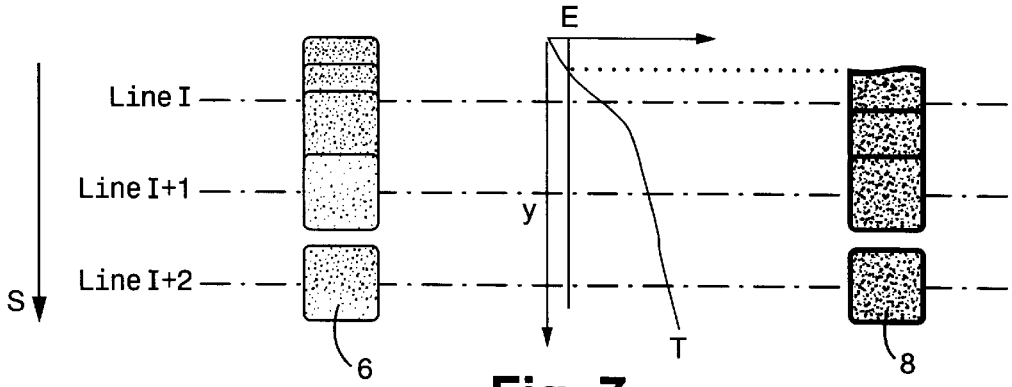
FIG. 7 represents magnetized recorded dots and the corresponding inked area on the drum and the energy balance using a third embodiment of the process according to the invention.

In the embodiment shown in FIGS. 3, 6 and 9, each image dot corresponds to a recorded dot. The magnetized recorded dots 6 correspond to determined black image dots, and unmagnetized recorded dots correspond to white image dots. Recorded dots are located at the intersection of a row given by the position of the drum 3 and a column given by the position of the elementary magnetic head 2. The column corresponds to the recording track 4.

The magnetographic printer comprises means of projecting ink particles onto drum 3; spraying means are used to spray ink particles 7 to the magnetized recorded dots 6. The inked area at the magnetized recorded dot 6 on drum 3 is denoted as reference 8 and is referred to in the following as the developed dot 8 (FIGS. 3, 6, 7 and 9).

According to this invention, the magnetographic printer comprises means 9 of detecting a leading edge 10. The leading edge 10 will be defined later in the description.

According to one embodiment of the invention (FIG. 4), the detection means 9 are composed of means 9A of memorizing rows of dots and means 9B of comparing the memorized rows. For example, the detection means 9 may be in the form of a programmable component, shown in the block diagram in FIG. 4. The component comprises storage means 9A represented by memory cells called "memory row i", where i may vary between 1 and n+2, and n represents the minimum number of unmagnetized dots or white image dots preceding at least the leading edge, and the comparison means 9B represented by a logical gate. In the example illustrated in FIG. 4, i varies between 1 and 4.

The following development presents details of problems that arise with conventional magnetographic printing processes. Coarse approximations have been made, and they are only valid for a qualitative explanation.

Assume three successive magnetized recorded dots 6A, 6B and 6C located on the same recording track 4 (FIGS. 2 and 3). The three magnetized recorded dots 6 correspond to three image dots belonging to three successive rows I, I+1 and I+2 respectively. Three successive current pulses are transmitted to the elementary magnetic head facing the recording track 4 concerned.

If the ink particle 7 facing the second magnetized dot 6B (row I+1) is to follow the drum 3, energy equal to at least:

$$E=\frac{1}{2}*m*V^2$$

must be supplied to it, assuming that the ink particle 7 is at rest when drum 3 goes past (which is a sufficiently close approximation for a description of problems that arise with conventional printing processes). "m" is equal to the mass of the ink particle, "v" is equal to the paper speed which is equal to the tangential drum speed.

When the second magnetized recorded dot 6B passes in front of the ink particle 7, the ink particle has already benefited from work done by the first magnetized recorded dot 6A. The energy of the ink particle is supplied by the work T of the magnetic development force. Therefore, when the ink particle is facing the second magnetized recorded dot 6B, the work is equal to the following, in a (y,z) coordinate system related to the drum 3:

$$T(y)=T_1+\int F(y)dy$$

where y is the tangential component of the coordinate system and z is the diametrical component; b is equal to the length tangential to the drum between the center of the magnetized recorded dot and the end of it; $T_1$ is equal to the work done by the first magnetized recorded dot.

It is assumed that the work T(y) is zero at y=b, and is a maximum at an absolute value for y=−b. As shown in FIG. 9, the energy E as a function of v increases as the paper speed v increases, and correspondingly the magnetic development work T will not be as effective in forcing the ink particle to be deposited on the drum; the development threshold T(y)=E moves along the y tangential axis; the result is a reduction in the inked area 7, namely a reduction in the optical density at the first 6A of the successive magnetized recorded dots 6A, 6B, 6C (row I). The second 6B and third 6C magnetized recorded dots (rows I+1 and I+2) are developed better than the first magnetized recorded dot 6A; they benefit from the work already done by the first magnetized recorded dot.

Magnetized recorded dots that do not belong to the leading edge are developed better than the magnetized recorded dots on the leading edge since they benefit from the work done by the magnetic development force for the preceding magnetized recorded dots.

In order to overcome the disadvantages of prior art, the process according to the invention consists of reinforcing the optical density of developed dots 8 on the leading edge 10.

The leading edge at distance n is composed of all magnetized recorded dots or black image dots which are preceded on the same recording track by n unmagnetized recorded dots or white image dots, contiguous along the drum rotation direction, where n is equal to at least 1. The number n depends on the printing technology.

According to one development of the invention, a leading edge is defined as a distance n and order m, where m is equal to at least 2. The distance corresponding to the number of unmagnetized recorded dots preceding the magnetized dot considered in the drum advance direction. The order m corresponds to the distance expressed as a number of recorded dots separating the recorded dot considered from the first unmagnetized recorded dot preceding it along the direction in which the drum is advancing. A leading edge with a distance n and order 1 corresponds to the previously defined leading edge. A leading edge with distance n and order m is composed of all magnetized recorded dots or black image dots that are preceded on the same recording track by a magnetized recorded dot or black image dots to be magnetized, contiguous along the direction of rotation of the drum and belonging to the leading edge with distance n and order m−1.

The set of leading edges with distance n and order m is denoted $BAD_nO_m$.

The leading edge $BAD_nO_m$ is included in the leading edge $BAD_{n-1}O_m$ which is itself included in the leading edge $BAD_{n-2}O_m$ and so on as far as leading edge $BAD_1O_m$.

$$BAD_nO_m \subset BAD_{n-1}O_m \subset \ldots \subset BAD_1O_m$$

In the embodiment as described and illustrated (FIG. 4), the number n is equal to 2 and the number m is equal to 1. A recorded dot or an image dot is considered as belonging to the leading edge with distance 2 and order 1 if and only if:

- the recorded dot in question is a magnetized recorded dot; the image dot is black;
- the recorded dot or image dot in question is preceded on the recording track or column in which it is located, by two unmagnetized dots or white image dots in the drum direction of rotation.

Two recorded dots or image dots are contiguous if they are located on two successive rows separated by one pitch.

Figure 5:
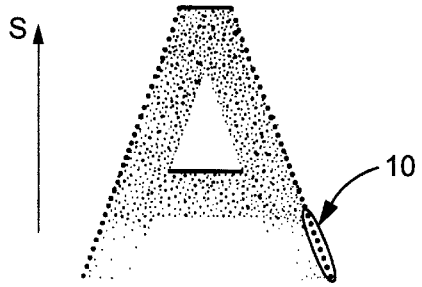
FIG. 5 represents the image to be printed.

FIG. 5 shows the leading edge of the black image, whereas the other image dots are grey.

In order to detect the leading edge (FIG. 4), the detection means 9 operate as follows; storage means 9A store a number n+1 of rows of image dots. Comparison means compare the last of the n+1 rows stored with the n image dot rows stored column by column in real time to detect image dots on the leading edge. The control unit 5 is connected to the detection means 9; the results of the comparison are sent to the control unit. The comparison made is transmitted, storage means 9A delete the last of the n+1 rows stored in time and store the next row in the drum direction of rotation. The comparison means compare the said next row with the n other rows stored and so on.

In order to accelerate printing, a number n+2 of image dot rows are memorized; the storage means 9A store a new row while comparison means 9B are simultaneously working on the n+1 stored rows as described above.

In the embodiment illustrated in FIG. 4, the programmable component operates as follows; a row of image dots is stored in memory 9A, and the row of dots is written into memory row i modulo 4. Simultaneously, row (i−1) modulo 4 is compared with rows (i−2) modulo 4 and (i−3) modulo 4. If a black image dot in row (i−1) modulo 4 is preceded by two white dots in rows (i−2) modulo 4 and (i−3) modulo 4, the black image dot in question in row (i−1) modulo 4 forms part of the leading edge. The detection means 9 inform the control unit 5 that the black image dot in question is a dot on the leading edge. The next row of dots is then processed in the same way by incrementing the value of i by 1.

One of the embodiments of the process according to the invention consists of increasing the energy supplied to recorded dots to be magnetized on the leading edge detected with respect to the energy supplied to other recorded dots to be magnetized that do not belong to the leading edge.

Several solutions are possible for increasing the energy input to recorded dots to be magnetized on the leading edge.

According to a first embodiment of the invention (FIG. 6), the peak current of the pulse transmitted to the elementary magnetic head 2 to magnetize the detected recorded dots on the leading edge (row I), is increased above the value of the peak current of the pulse transmitted to magnetize the other recorded dots (rows I+1 and I+2) that do not belong to the leading edge.

According to a second embodiment of the invention (FIG. 6), the duration of the pulse transmitted to the elementary magnetic head 2 to magnetize the recorded dots on the detected leading edge (row I), is increased above the duration of the pulse transmitted to magnetize the other recorded dots (rows I+1 and I+2) that do not belong to the leading edge.

According to a third embodiment of the invention (FIG. 7), several pulses are transmitted to the elementary magnetic head 2 to magnetize the recorded dots on the detected leading edge (row I), whereas a single pulse is transmitted to magnetize the other recorded dots (rows I+1 and I+2) that do not belong to the leading edge.

The third embodiment is described in more detail below; considering a magnetized recorded dot that is not preceded by magnetized recorded dots on its recording track 4 (FIGS. 8 and 9).

If the ink particle 7 is to follow the drum 3, the energy supplied to it must be equal to at least:

$$E=\tfrac{1}{2}*m*V^2$$

assuming that the ink particle is at rest as the drum passes (a sufficiently accurate approximation to describe the problems that arise with conventional processes). "m" is equal to the mass of the ink particle, "v" is the paper speed that is equal to the tangential speed of the drum.

The energy of the ink particle is provided by the work T done by the magnetic development which, expressed in a (y,z) coordinate system related to the drum 3, is equal to:

$$T(y)=\int F(y)dy$$

where y is the tangential component of the coordinate system and z is the diametrical component; b is equal to the length tangential to the drum between the center of the magnetized recorded dot and the end of the dot.

It is assumed that the work T(y) is zero at y=b and that its absolute value is a maximum at y=−b. As shown in FIG. 3, the energy E as a function of v increases as the paper speed v increases, and correspondingly the magnetic development work T will take longer to effectively deposit the ink particle on the drum; the development threshold T(y)=E moves along the y tangential axis; the result is a reduction in the area of the developed dot 8 at the first magnetized recorded dot 6, namely a reduction in the optical density of the said developed dot transferred to paper.

The third embodiment consists of creating at least two magnetized recorded dots 6 for each black image dot to be printed.

Figure 10:
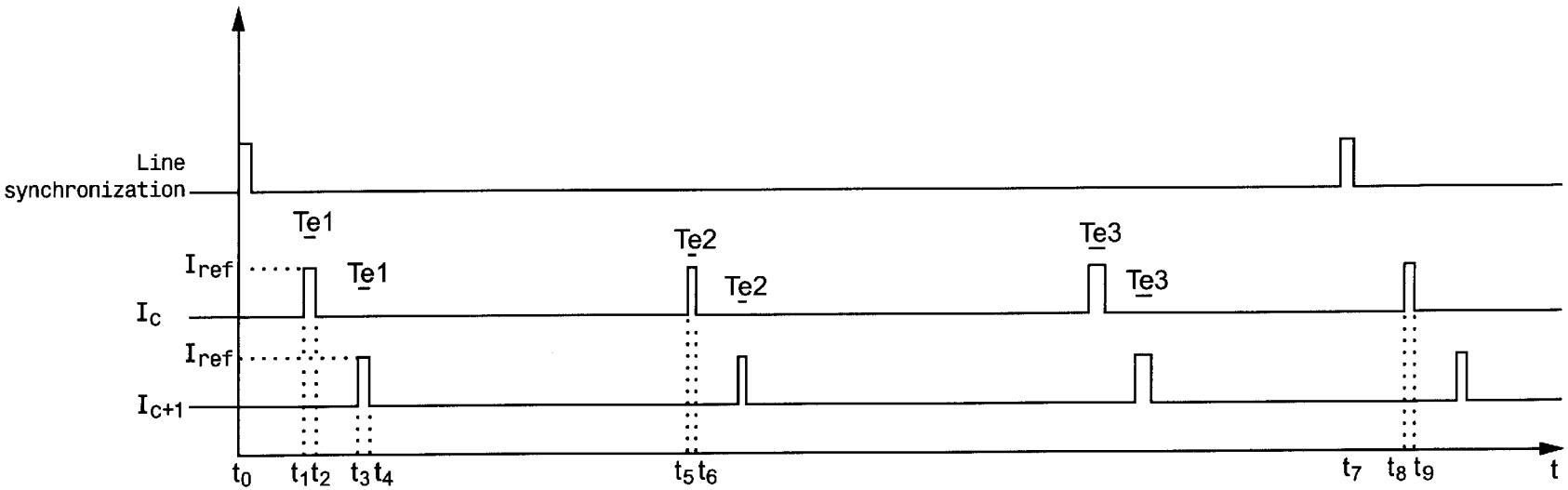
FIG. 10 is a diagram representing the current passing through the elementary magnetic head as a function of time, using the process according to the third embodiment of the invention illustrated in FIG. 7.

As shown in FIG. 10, the pulse $I_c$ generated between $t_1$ and $t_2$ corresponds to the first magnetized recorded dot on row I and column c; the pulse $I_{c+1}$ generated between $t_3$ and $t_4$ corresponds to the first magnetized recorded dot on row I and column c+1; the pulse $I_c$ generated between $t_8$ and $t_9$ corresponds to the first magnetized recorded dot on row I+1 and column c; the pulse $I_c$ generated between $t_5$ and $t_6$ corresponds to the second magnetized recorded dot on row I and column c. Several magnetized recorded dots correspond to each black image dot.

The process according to the third embodiment consists of transmitting several current pulses $I_{ref}$ to the elementary magnetic head 2 (FIG. 10) distributed on the same row of the image. In the embodiment shown in FIGS. 7 and 10, the control unit transmits three current pulses per row.

In the example illustrated, the amount of energy injected in the magnetized recorded dot is identical if one or several pulses are sent; the total duration of all pulses is identical to the duration of the single pulse. Thus, if each pulse has a duration of 360 nanoseconds when one pulse is emitted per row, the optical density of the developed dots is 0.14. If there are two pulses per row, each pulse having a duration of 180 nanoseconds, the optical density of the developed dots is 0.19. If there are three pulses per row, with each pulse having a duration of 120 nanoseconds, the optical density of the developed dots is 0.24.

Using the same energy as in conventional printing processes, the optical density of developed dots increases by almost 50%. Furthermore, the power dissipated in the elementary magnetic heads may reduce.

Current pulses may have a variable intensity and duration. The duration between two pulses may vary.

The process according to the third embodiment consists of creating at least two magnetized dots 6 per black image dot belonging to the leading edge. The optical density of the leading edge is reinforced using the same energy to magnetize recorded dots on the leading edge as to magnetize other dots.

In all embodiments of the process according to this invention, the power consumed in the elementary magnetic heads 2 may be less than the power consumed in the case of a process providing identical energy to all magnetized recorded dots. In order to obtain correct development of the leading edge, the energy supplied in prior art had to be increased for all dots in the image. If the energy of magnetized dots on the leading edge is increased, the power consumed for other magnetized dots can be reduced. In conventional images, leading edges represent from 5 to 30% of all magnetized recorded dots.

Thus for example, to print a test page according to a conventional printing process, a pulse of the order of 280 nanoseconds is necessary for all magnetized recorded dots. Using the process according to the invention, three 160 nanosecond pulses are necessary on leading edges, and only one 160 nanosecond pulse is necessary for the other magnetized recorded dots, such that the energy supplied is greater than for the conventional printing process for the leading edge, and is less for other magnetized recorded dots.

If the consumed power is calculated and the optical density of developed dots is measured using the two processes at a drum speed of 105 meters/minute, the following results are obtained.

Assuming that the power dissipated in the elementary magnetic heads is due to resistive losses in row resistances, the energy necessary to print the image according to the conventional printing process is:

$$E=N_d*T_e*r*I^2$$

where $N_d$ is the number of magnetized recorded dots;

$T_e$ is the write time;

r is the internal resistance of the winding and connecting wires;

I is the control current for the magnetized recorded dot.

The following values are used:

r=15 ohms;

Te=280 $10^{-9}$ seconds;

I=350 milliampers

Nd=9.1 $10^6$ black image dots (image dots to be magnetized).

The energy is equal to:

$E=9.1\ 10^6*280\ 10^{-9}*15*0.35^2$

E=4.7 joules

The energy necessary to print the image using the printing process according to the invention is:

$$E=N_d*T_e*r*I^2+2N_{ba}*T_e*r*I^2$$

where $N_{ba}$ is the number of magnetized recorded dots on the leading edge;

The following values are used:

r=15 ohms;

Te=160 $10^{-9}$ seconds;

I=350 milliampers;

$N_d$=9.1 $10^6$ black image dots;

$N_{ba}$=1.5 $10^6$ black image dots belonging to the leading edge (about 16% of the black dots in a conventional image).

The energy is equal to:

$E=9.1\ 10^6*160\ 10^{-9}*15*0.35^2+2*1.5\ 10^6*160\ 10^{-9}*15*0.35^2$

E=3.5 joules.

Therefore the consumed energy is lower when the process according to the invention is used.

The measured optical density with the conventional process is 0.21, and is equal to 0.27 with the process according to the invention.

Therefore, this invention has the advantage that it improves the printing quality while reducing the consumed power.

Note that any other embodiment could be considered. Thus, in the embodiment illustrated, the magnetized recorded dots on leading edges $BAD_2O_1$ are detected and receive higher energy than the other magnetized dots. According to a development of the invention, the energy received at the magnetized recorded dots reduces from one row to the next starting from the leading edge.

Energy $BAD_nO1$>Energy $BAD_nO2$>

The energy supplied to the magnetized recorded dots depends on the leading edge $BAD_nO_m$ to which they belong; for constant n, the energy decreases when m increases. Note that for constant m, the energy increases when n increases.

The magnetographic printing process according to this invention consists of creating magnetized recorded dots on the surface of the magnetic recording element 3 by means of at least one elementary magnetic head 2, projecting ink particles on each of the magnetized recorded dots in order to form images made up of image dots, the magnetized and inked recorded dots being called developed dots. The process is characterized in that it consists of reinforcing the optical density of developed dots on the leading edge.

According to one embodiment of this invention, the process consists of increasing the energy supplied to magnetized recorded dots on the leading edge to be greater than with the energy supplied to other magnetized recorded dots.

The process consists of detecting image dots on the leading edge and increasing the energy supplied to magnetized recorded dots on the leading edge.

According to another embodiment of the process according to this invention, the process consists of creating at least two magnetized recorded dots per image dot on the leading edge.

According to a development of this invention, the energy of magnetized recorded dots decreases in the direction of rotation of element 3 starting from the leading edge as a function of the order of the leading edge.

The energy of magnetized recorded dots on the leading edge increases as the distance from the leading edge increases.

The process increases the energy by modulating electrical signals passing through the elementary magnetic head 2.

This invention also relates to a printer capable of using the process as described previously.

The magnetographic printer according to this invention comprises at least one elementary magnetic head capable of creating magnetized recorded dots on the surface of the magnetic recording element 3, means 5 of controlling the elementary magnetic head 2, means of spraying particles of ink on each of the magnetized recorded dots in order to form images composed of image dots. The printer is characterized in that it comprises means of detecting the leading edge in liaison with the control means 5.

According to one embodiment, the detection means comprise means of memorizing at least two rows of image dots and means of comparing the rows column by column.

What is claimed is:

1. A magnetographic printing process consisting of the steps of:

creating magnetized recorded dots on a surface of a magnetic recording element (3) by means of at least one elementary magnetic head (2); and spraying ink particles on each of the magnetized recorded dots in order to form images composed of image dots, magnetized and inked recorded dots being called developed dots, characterized in that said spraying step consists of increasing the optical density of developed dots belonging to the leading edge.

2. A process according to claim 1, characterized in that said spraying step consists of detecting image dots on the leading edge and increasing the energy supplied to the magnetized recorded dots on the leading edge compared with the energy supplied to other magnetized recorded dots.

3. A process according to claim 1, characterized in that said spraying step consists of creating at least two magnetized recorded dots for each image dot on the leading edge.

4. A process according to claim 1, characterized in that the energy of the magnetized recorded dots decreases along the direction of rotation of element (3) starting from the leading edge as a function of the order of the leading edge.

5. A process according to claim 1, characterized in that the energy of the magnetized recorded dots on the leading edge increases when the distance from the leading edge increases.

6. A process according to claim 1, characterized in that said spraying step increases the energy by modulating the electrical signals passing through the elementary magnetic head (2).

7. A printer capable of implementing the process according to claim 1.

8. A magnetographic printer comprising:

at least one elementary magnetic head (2) capable of creating magnetized recorded dots on a surface of a magnetic recording element (3);

means (5) for controlling the elementary magnetic head (2), means of spraying ink particles on each magnetized recorded dot in order to form images composed of image dots, characterized in that said control means comprises means of detecting the leading edge in liaison with control means (5).

9. A printer according to claim 8, characterized in that the detection means include storage means for at least two rows of image dots and means of comparing rows column by column.

10. A magnetographic process for increasing printing efficiency, said process comprising:

creating magnetized recorded dots on a surface of a magnetic recording element by means of at least one elementary magnetic head; and spraying ink particles on each of the magnetized recorded dots to create images having image dots, characterized in that said spraying step increases the optical density of dots that are developed and belonging to a leading edge.

11. A process as in claim 10, wherein said spraying step further comprising:

detecting image dots on the leading edge; and increasing energy supplied to the magnetized recorded dots on the leading edge.

12. A process as in claim 11, further comprising:

creating at least two magnetized recorded dots for each image dot on the leading edge.

13. A process as in claim 12, further comprising:

decreasing the energy of the magnetized recorded dots along the direction of rotation of element starting from the leading edge as a function of the order of the leading edge.

14. A process as in claim 11, wherein the energy is increased by modulating the electrical signals passing through the elementary magnetic head.

15. A process as in claim 10, wherein the energy of the magnetized recorded dots on the leading edge increases as the distance from the leading edge increases.

16. A magnetographic printer apparatus, comprising:

at least one elementary magnetic head capable of creating magnetized recorded dots on a surface of a magnetic recording element;

means for controlling the elementary magnetic head; and means for spraying ink particles on each magnetized recorded dot to form images composed of image dots, said spraying means comprising means for detecting a leading edge in liaison with control means.

17. The apparatus as in claim 16, wherein said detection means comprises storage means for at least two rows of image dots and means of comparing rows column by column.

18. A magnetographic printer apparatus, comprising:

at least one elementary magnetic head for creating magnetized recorded dots on a surface of a magnetic recording element; and means for spraying ink particles on each of the magnetized recorded dots to create images having image dots, characterized in that said spraying means increases the optical density of dots that are developed and belonging to a leading edge.

* * * * *